US007156790B2

(12) United States Patent
Johnsen

(10) Patent No.: US 7,156,790 B2
(45) Date of Patent: Jan. 2, 2007

(54) TRAINING APPARATUS/CHAIR

(75) Inventor: Freddy Johnsen, Auli (NO)

(73) Assignee: BackUp AS, Auli (NO)

( * ) Notice: Subject to any disclaimer, the term of this patent is extended or adjusted under 35 U.S.C. 154(b) by 26 days.

(21) Appl. No.: 10/488,706

(22) PCT Filed: Sep. 16, 2002

(86) PCT No.: PCT/NO02/00325

§ 371 (c)(1),
(2), (4) Date: Mar. 5, 2004

(87) PCT Pub. No.: WO03/024538

PCT Pub. Date: Mar. 27, 2003

(65) Prior Publication Data

US 2004/0248714 A1 Dec. 9, 2004

(30) Foreign Application Priority Data

Sep. 17, 2001 (NO) ..... 20014502

(51) Int. Cl.
*A63B 22/16* (2006.01)

(52) U.S. Cl. ..... 482/146; 482/112

(58) Field of Classification Search ..... 482/146, 482/34, 79, 147, 62, 77; D21/662, 665, 688–89
See application file for complete search history.

(56) References Cited

U.S. PATENT DOCUMENTS

| | | | | |
|---|---|---|---|---|
| 2,550,992 A | | 5/1951 | Goodrich | |
| 4,186,920 A | * | 2/1980 | Fiore et al. | 482/79 |
| 5,092,586 A | | 3/1992 | Tuthill et al. | |
| 5,728,049 A | * | 3/1998 | Alberts | 601/24 |
| 5,810,751 A | | 9/1998 | Meier et al. | |

FOREIGN PATENT DOCUMENTS

| | | | |
|---|---|---|---|
| DE | 198 37 963 | | 2/2000 |
| DE | 20115323 | | 4/2002 |
| GB | 1 541 288 | | 2/1979 |
| GB | 1541288 | * | 2/1979 |

* cited by examiner

*Primary Examiner*—Lori Amerson
(74) *Attorney, Agent, or Firm*—Wenderoth, Lind & Ponack, L.L.P.

(57) ABSTRACT

A device is provided for exercising the muscles of the back, which includes a chair seat and a rod fastened to a feet plate. The feet plate is coupled to a tilting member which is surrounded by a damping member. The damping member can rest on a bottom plate which is fastened by a fastening member. A cloth which surrounds the damping member and is fastened to the feet plate can replace the bottom plate and the fastening member. It is further an advantage that the rod is telescopic. The tilting member can have a circular cross section and a downwardly conical form. The damping member which surrounds the tilting member is of a flexible material and may be fastened to the feet plate by the fastening means member which can assist in dampening the movement of the tilting member.

7 Claims, 3 Drawing Sheets

TRAINING APPARATUS/CHAIR

BACKGROUND OF THE INVENTION

The present invention relates to a device for exercising the muscles of the back.

Quite a few people have problems with their back, and the most common reason is that one is seated while working and generally gets too little exercise such that the muscles of the back are not trained and, therefore, do not give the necessary support to the spine. Incorrect position while seated may in addition result in various back problems.

There exist several training apparatuses and devices, but few of these are primarily for training of the back muscles. From GB 1,541,288 there is known a kind of ergo meter bicycle which comprises a seat with a back support, the height of which is adjustable and rests directly on a sphere shaped body. The seat can accordingly be subjected to a rolling and tilting movement. The person using the device places their feet on pedals at the front part of the device which simulate a bicycle. The device comprises several other means, and it is accordingly complicated and expensive.

There are also known other devices which can give the user a tilting movement. For example, from the German patent publication DE 1,983,7963 A1 a semi sphere shaped device is known which rests on a bearing in a frame. On the semi sphere body there can be fastened a rigid holding rack. To the lower part of the semi spherical body there can be fastened a band secured to the side edge of the frame. The band will somewhat dampen the movements of the body. This is a device for training balance while standing upright. This device will, however, not be suitable for training of the back muscles in an efficient way.

A similar device is also known from U.S. Pat. No. 5,613,690 where a semi sphere shaped body is fastened to an upper plate which rests on a bottom plate. The two quadratic plates are secured to each other by springs, one in each corner. The device is connected to a computer in order to register the movements such that the balance training can be optimized. This device, however, is not suited for efficient training of the muscles of the back.

SUMMARY OF THE INVENTION

The main object of the invention is to arrive at a simple and cheap device for training the muscles of the back and for treatment of already existing damages. The device should be small and applicable. The device should provide exercise for the back and, at the same time, the person should be able to sit for performing possible work.

Having studied known devices in the field and more general training and exercising apparatuses, the inventor found that the user should sit during the exercise because so many people having problems with their back are sitting most of the day. One should then initiate tilting movements which engage the muscles in the back and thereby strengthen the musculature in a sitting position.

The device is a special chair for exercising the back. The person sitting on the chair must maintain their balance and, thereby, the muscles in the spine are exercised. With their seat on the chair seat 1 and their legs on a feet plate 3, the person balances by means of the functional parts 4, 5, 6 and 7.

BRIEF DESCRIPTION OF THE DRAWINGS

The invention will be further explained and envisaged in connection with the description of the device, where.

DETAILED DESCRIPTION OF THE INVENTION

Figure 1:
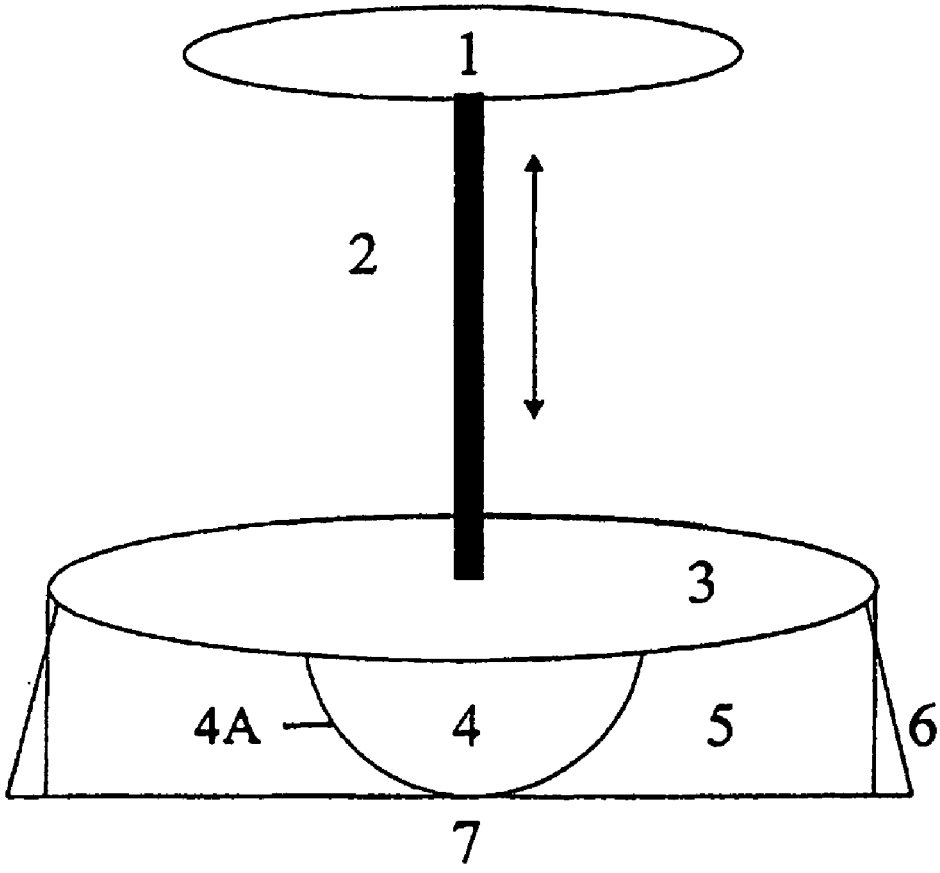
FIG. 1 shows in perspective a device according to the invention.
Figure 2:
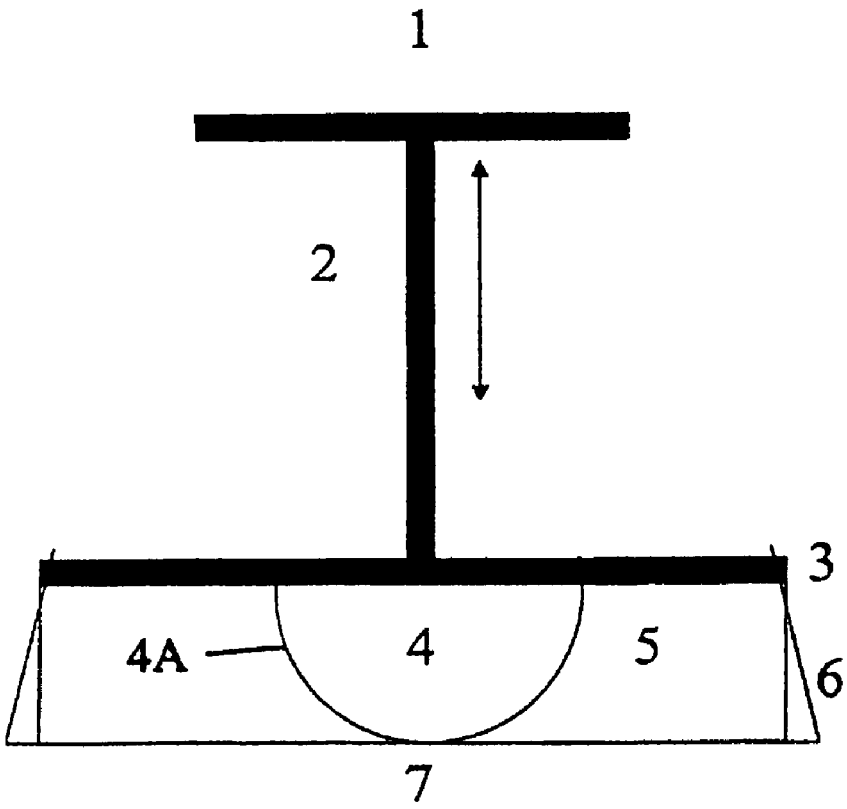
FIG. 2 shows a vertical view of one embodiment of the invention.

FIGS. 1 and 2 show a chair seat 1 and a telescopic rod 2 which is connected to the bottom plate 3. The feet plate 3 is coupled to a tilting means 4 which is surrounded by damping means 5. The damping means 5 can rest on a bottom plate 7 secured with fastening means 6.

Figure 3:
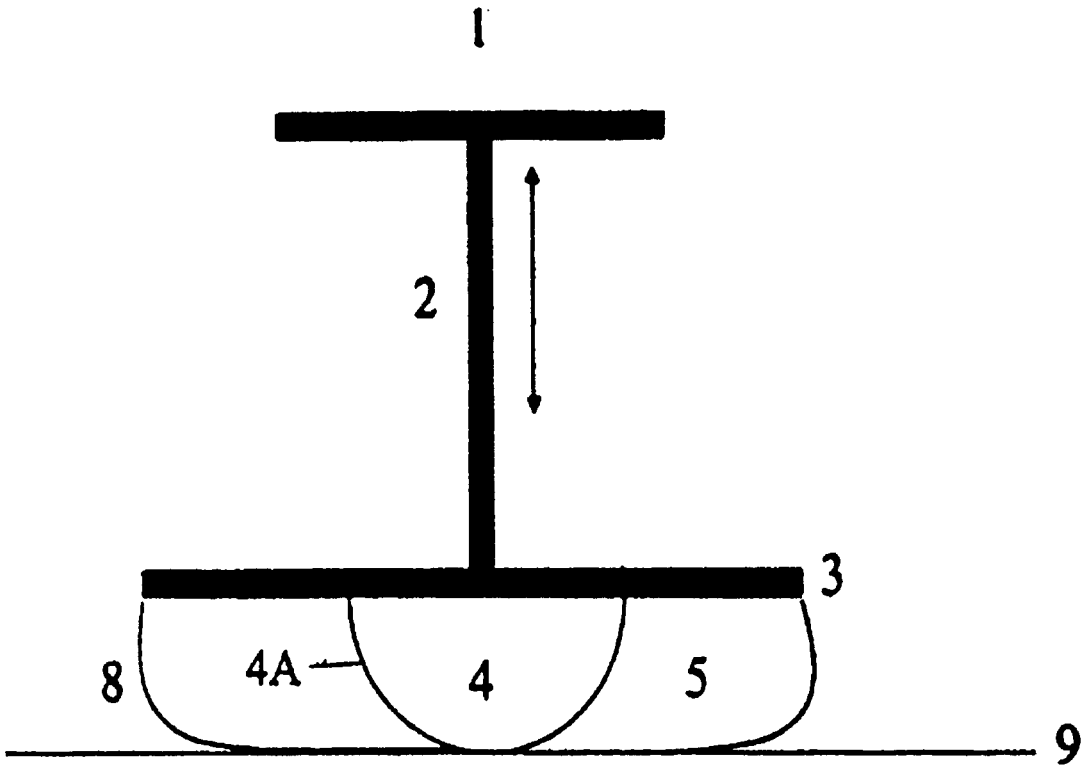
FIG. 3 shows a second embodiment of the invention.

FIG. 3 shows an alternative embodiment of the invention where a cloth 8 surrounds the damping means 5 and is secured to the feet plate 3, replacing the bottom plate 7 and the fastening means 6. Here, the volume defined by the bottom plate 3 and the cloth 8 may be filled by damping means 5. As shown in FIG. 3, the bottom edges of the chair are slightly rounded off. 4A denotes the surface of the tilting means. The surface may either be in the form of a spherical or substantial spherical shape or it may be formed by a truncated cone, the lower surface of which may be rounded off.

The chair seat 1 is vertically adjustable and is preferably round. The chair seat 1 is secured to the feet plate 3 by means of at least one rod, for instance, the telescopic rod 2. By means of the telescopic rod 2, the distance between the chair seat 1 and the feet plate 3 can be regulated and adjusted to the person sitting on the chair. The bottom plate 3, which preferably is circular, should be of a size such that the person sitting on the chair easily can fix their legs on the feet plate 3.

The tilting means 4 is fastened to the feet plate 3. The tilting means 4 may have a downward conical form, for instance a semi spherical shape, and is preferably made of a solid material, for instance a polymer material. Other suitable shapes of the tilting means 4 may be applied. It might for instance have a downward curved shape, for instance convex. The diameter of the tilting means 4 should be equal to or smaller than the diameter of the feet plate 3.

The tilting means 4 rests on a bottom plate 7 which is at least as large as the damping means 5. The bottom plate 7 is preferably equipped with movement promoting means on it's under side, for instance wheels. The bottom plate 7 can also be in form of a cloth which is secured to the feet plate 3.

The damping means 5 fills the space between the feet plate 3, the tilting means 4 and the bottom plate 7. The damping means 5 stabilizes the chair such that it is possible to maintain balance. The damping means 5 may consist of a flexible material, for instance, foamed polymer material, other types of polymer material, air or liquid. The damping means 5 can be adjustable such that the damping can be adjusted as needed.

The combined damping means 5 and fastening means 6 secures the bottom plate 7 to the feet plate 3. The combined damping means 5 and the fastening means 6 can for instance be elastic or resilient and can thereby assist in damping the movements of the tilting means 4.

The special feature of the invention is that the device comprises a chair seat secured to the feet plate by at least one rod. The distance between the seat and the feet plate can be regulated vertically. A tilting means is secured to the feet plate and the tilting means is surrounded by a damping means.

It is further an advantage that the rod is telescopic.

The tilting means has preferably a circular cross section and a downward conical shape. The damping means which lies against the tilting means is preferably made of a flexible material.

The tilting means can be arranged to a fastening means secured to the feet plate and a bottom plate.

The damping means can be fastened to the feet plate with at least two fastening means which can be in the form of springs which can assist in dampening the movements of the tilting means.

The damping means can be fastened to a bottom plate which is secured to the feet plate with fastening means.

The damping means can be surrounded by a cloth which fastens the damping means to the feet plate and where the cloth is functioning both as a bottom plate and a fastening means.

By the present invention the inventor has succeeded in arriving at a device which is both simple and inexpensive. During testing it has been found that the user can sit firmly on the chair and still get excellent exercise of the muscles of the back.

The invention claimed is:

1. A device for exercising muscles of the back, said device comprising:

a seat;

a feet plate coupled to said seat by at least one rod;

a tilting member coupled to said feet plate; and a damping member disposed so as to surround said tilting member, wherein said damping member comprises a flexible material, and wherein said damping member is coupled to said feet plate.

2. A device according to claim 1, where a distance between said seat and said feet plate can be vertically adjusted.

3. A device according to claim 1, wherein said tilting member has a circular cross section and a downward conical form.

4. A device according to claim 1, wherein said damping member is at least partially surrounded by a covering member which couples said damping member to said feet plate.

5. A device according to claim 1, wherein said seat is arranged for a user of said device to sit thereon.

6. A device according to claim 1, wherein said feet plate is arranged for a user of said device to place at least one of their feet thereon.

7. A device according to claim 1, wherein said damping member comprises a polymer material.

* * * * *